US007611070B2

(12) United States Patent
Paoluccio

(10) Patent No.: US 7,611,070 B2
(45) Date of Patent: Nov. 3, 2009

(54) ASPIRATING SCENTED OXYGEN ENRICHED FAUCET AND SHOWER HEAD

(76) Inventor: John J. Paoluccio, 4801 Quinturn La., Modesto, CA (US) 95354

( * ) Notice: Subject to any disclaimer, the term of this patent is extended or adjusted under 35 U.S.C. 154(b) by 0 days.

(21) Appl. No.: 11/307,914

(22) Filed: Feb. 28, 2006

(65) Prior Publication Data

US 2007/0210185 A1 Sep. 13, 2007

(51) Int. Cl.
*E03C 1/08* (2006.01)

(52) U.S. Cl. ..... 239/9; 239/34; 239/310; 239/318; 239/335; 239/419.5; 239/525; 239/590; 239/428.5; 239/10; 4/903

(58) Field of Classification Search ..... 239/310–318, 239/326, 525, 530, 532, 575, 590, 590.3, 239/427, 427.3, 325, 34, 57, 289, 335, 419.5, 239/428.5, 1, 6, 8, 9, 10; 4/605, 675, 903
See application file for complete search history.

(56) References Cited

U.S. PATENT DOCUMENTS 3,917,172 A * 11/1975 O'Hare ..... 239/312
4,294,280 A * 10/1981 Tom ..... 239/310
4,623,095 A * 11/1986 Pronk ..... 239/311
4,941,616 A * 7/1990 Liebler ..... 239/310
5,915,622 A * 6/1999 Foote ..... 239/317
5,961,049 A * 10/1999 Kaps et al. ..... 239/428.5
6,419,166 B1 * 7/2002 Brzezinski et al. ..... 239/310
6,647,566 B1 * 11/2003 Wang ..... 4/903
7,093,775 B1 * 8/2006 Bingham ..... 239/310
7,147,172 B2 * 12/2006 Darling et al. ..... 239/302

* cited by examiner

*Primary Examiner*—Steven J Ganey

(57) ABSTRACT

A plumbing fixture including an aspirating type showerhead operates to add a selected scent to the spray water. The showerhead utilizes a venturi assembly where the water supply passes through a venturi. A negative pressure is created at the high velocity water jet stream point, near the narrow area of the venturi. A number of small openings in the venturi, to a surrounding air chamber, allow air from the chamber, to be drawn into the venturi. The air chamber has inlet openings for the aspiration of room air. At a portion of these inlet openings is a quick connect port to receive a scented cartridge. The scent cartridge is then inserted into the quick connect port of the showerhead. Room air is then drawn through and over the scent cartridge where the high velocity air picks up scent molecules from the scented wick within the cartridge.

18 Claims, 11 Drawing Sheets

ASPIRATING SCENTED OXYGEN ENRICHED FAUCET AND SHOWER HEAD

BACKGROUND OF THE INVENTION

The invention relates generally to plumbing apparatus such as showerheads and faucets. While the description will particularly emphasize a showerhead application used for bathing and intended to produce an aromatic effect, those skilled in the art will recognize that even a faucet may be equipped and/or constructed to dispense an aromatic substance. One embodiment of the apparatus in accordance with the present invention adds a pleasant scent and uses the shower head to dispense the fragrance.

The use of scented oils and waxes, gels, lotions, room air fresheners, soaps and shampoo's have gained in popularity and many of these products can be found in almost every household. One of the more pleasurable moments is relaxing and enjoying a good shower. Previous methods of enhancing this experience include introducing a scent in a shampoo or soap. However, one then ends up with only one convenient aroma. In recent years scent oils and gels have been added to the water within or leaving the conventional showerhead. A number of disadvantages occur with this method of adding a scent to the shower compartment. Concentrated oil or gel that is mixed directly with the water may irritate the user's eyes. In addition, most of the rather expensive scent oil and gels mix with the water and go directly down the drain.

Some prior art apparatus use an attachment device in the showerhead where a gel tablet is placed. The gel is squeezed by the supply water pressure to release the scent material from the gel capsule. In other methods scented oil is mixed in the water outside the showerhead. Scents are also accomplished by use of soaps and shampoos. The net result is the body is exposed to the direct scent oils in contact with the body.

Many conventional shower heads simply convey the inlet water stream into a desired spray pattern. Many water supply systems are supplied by well water. This water usually has a low level of dissolved oxygen in the water. Many rural well supplies have less than one part per million of dissolved oxygen in the water. The low level of dissolved oxygen results in less cleaning action and may have a foul smell. As a result, these shower heads utilize more water when showering because it takes longer to clean ones body than an air aspirating type showerhead. With less dissolved oxygen in the water, more water is used hence; more energy is used to heat the water.

When a scent or aroma is desired with conventional showerheads a scented oil or gel is frequently used. The oil is placed directly to the supply water stream where mixing occurs. This results in large quantities of oil being used because concentrated liquid (oil) is mixed with liquid (water). This prior art technology results in a waste of scented oil or gel as most of it is mixed into water droplets of the spray and end up going down the drain.

The prior art methods and apparatus for adding a scent to the shower water are wasteful, cumbersome, expensive, ineffective and harmful to the environment. When scent oils or gels are mixed directly with the supply water and come in contact with the body, especially the eyes and mucus membranes of the face, irritation can occur. In addition, more soap is used to dissolve the oil to have a clean feeling. Longer showers result and more energy being used to heat the shower water. The consequent increased energy production results in more air pollution as well as the consumption of scarce resources.

The sensation of smell is apparent from the presence of a relatively few molecules at the nostrils. Since one only smells the scent molecules in the air it is wasteful to have the scent oil mixed with water and locked in solution. It does little good and large quantities of scent oil material are used in the shower water with this prior method. This results in an oily film over the entire body and many times as much scent material is used and wasted.

Almost all the scent oils go right down the drain where they add to water pollution that can ultimately contaminate our groundwater. In addition, conventional showerheads result in water sprays with less dissolved oxygen in the shower stream and this result in a less than fresh odor.

In addition, as the world population increases, more water supplies are derived from deep wells. Water from these wells generally has a very low level of dissolved oxygen. The level may be less than one part in a million. This reduces the probability of oxidation of the piping used to deliver the water, however, the water having a low level of dissolved oxygen is less pleasant for the user that bathes with this water.

The prior art methods of adding a scent to shower water is wasteful, cumbersome, expensive, ineffective and harmful to the environment. When scent oils or gels are mixed directly with the supply water and come in contact with the body, especially the eyes and mucus membranes of the face, irritation can occur. In addition, more soap is used to dissolve the oil to have a clean feeling. Longer showers result and more energy being used to heat the shower water. Excess energy consumption results in more air pollution.

A person will perceive a smell if only a relatively few molecules scented material reaches the nostrils of the person. Since a person only perceives the aroma of scented molecules in the air, it is wasteful to have the scented oil mixed with water. Most of the scented oil does little good and large quantities of scented oil material are used in the shower water with this prior method. This results in an oily film over the entire body and many times as much scent material is used and wasted.

Almost all the scent oils go right down the drain and this adds to water pollution that can ultimately contaminate our groundwater.

In addition, conventional showerheads result in water sprays with less dissolved oxygen in the shower stream and this result in a less than fresh odor.

An additional consideration in the design of a showerhead is that most well water has a rather low level of dissolved oxygen, frequently less than one part per million. Water with this low level and of dissolved oxygen does not clean as well as aerated water that is enriched with oxygen.

SUMMARY OF THE INVENTION

An object to the present invention is to provide an improved scented aspirating showerhead that results in a fast and easy way to add a scent to ones shower.

A further object of this invention is to provide an apparatus and method for adding a selected scent to shower water from an aspirating type showerhead and more particularly to utilize a scented material may be oil, wax, gel or other liquid material that may, in some cases, be provided in a sealed cartridge and may have any one of a wide variety of aromas.

Still another object of the present invention is to provide an apparatus and method which allows the use of a scent cartridge that may be activated and inserted into an attachment port of the showerhead.

Another object of this invention is to provide a showerhead that increases the oxygen content of the water flowing through the showerhead and utilizes the oxygen enriched water that occurs with the aspirating showerhead, because the additional oxygen results in less scent material being necessary and adds freshness to the water. While this objective is particularly relevant to water from deepwater wells, it will be understood by those skilled in the art that it has application to water from all conventional sources.

A further object of this invention is to keep the scented oil from directly mixing with the water supply and to only allow aspirated air to flow over the scented material and, more particularly, to remove fragrance molecules from an aromatic substance, position and them in an air stream and then mixed the fragrance molecules with water directed at the individual who is bathing, whereby the least amount of scent material is used and thereby reduce the waste of scented oils.

It is a further object of this invention to primarily add scented molecules to an air portion of the oxygenated shower stream so they are released as soon as they flow over one taking a shower. This method surrounds ones entire body with the desired altered environment within the shower compartment.

Still another object invention is to provide a method and apparatus that allows the user to, at any time, change the fragrance by simply replacing a first scent cartridge with another scent cartridge to produce different aroma.

Yet another object invention is to provide a method and apparatus which will avoid direct contact of any scented liquid oil, gel, soap, or wax with the person taking a shower. More particularly, is an object of the present invention to allow only the scent molecules mixed with air and water to bath the body.

It is now been found that these and other objects of the invention may be attained in a plumbing fixture which includes a reservoir for receiving a quantity of scented material, a first fluid passageway for conducting a first fluid stream, and a venturi that include fluid communication with the first fluid stream, the venturi produces a pressure that is less than the ambient pressure. The apparatus also includes fluid communication intermediate the reservoir for receiving scented material and the pressure that is less than the ambient pressure to produce a mixture of scented material and air; and fluid communication intermediate (1) the mixture of scented material and air and (2) the first fluid stream.

In various embodiments of the invention the plumbing fixture the first fluid stream is water and the fixture is a showerhead or a faucet.

The showerhead apparatus embodiment may include a first fluid passageway for conducting a stream of water; a venturi in fluid communication with the first fluid passageway, the venturi producing an air pressure that is less than ambient air pressure as a result of the passage of the stream of water; and a second fluid passageway dimensioned and configured for receiving a scent material. The second fluid passageway may being disposed in fluid communication with (1) the air pressure that is less than in an air pressure and (2) the first fluid passageway for conducting a stream of water whereby the flow of water in the first fluid passageway creates a pressure that is less than the ambient air pressure and scent material is drawn from the second fluid passageway into the first fluid passageway and mixes with the stream of water flowing through the first fluid passageway.

In some embodiments of the showerhead the first fluid passageway is tubular and the second fluid passageway extends radially from the first fluid passageway. The second fluid passageway may be dimensioned and configured for receiving a scent cartridge. The second fluid passageway may be dimensioned and configured for receiving an elongated scent cartridge or dimensioned configured for receiving an annular scent cartridge that is dimensioned configured for surrounding the first fluid passageway. In some embodiments of the showerhead the second fluid passageway includes a scent material. The scent material may be a top note type fragrance. The scent cartridge may include a wick. The scent cartridge may be dimensioned in configured to permit the user to snap axial portions thereof apart to expose the contents of the cartridge to the ambient where the cartridge is located.

Other embodiments of the showerhead may further include an external canister for holding a scent material that is disposed outside the second fluid passageway and includes fluid communication with the second fluid passageway.

The invention also includes the method for producing an aromatic fluid stream which includes providing a reservoir of scented material; providing a plumbing fixture having an inlet for cooperation with an associated water supply in fluid communication with an outlet for disbursing water from the fixture; providing a venturi in a fluid stream intermediate the inlet and the outlet to produce an air pressure that is less than ambient air pressure; utilizing the air pressure that is less than ambient air pressure to direct molecules of scented material in the reservoir within an air stream; and mixing the air stream with the molecules of scented material with a water stream from the associated water supply.

BRIEF DESCRIPTION OF THE DRAWING

These and other, further and more specific objects and advantages of the invention will be apparent to those skilled in the art from the following detailed description thereof, taken in conjunction with the drawings, in which.

DESCRIPTION OF THE PREFERRED EMBODIMENTS

Figure 1:
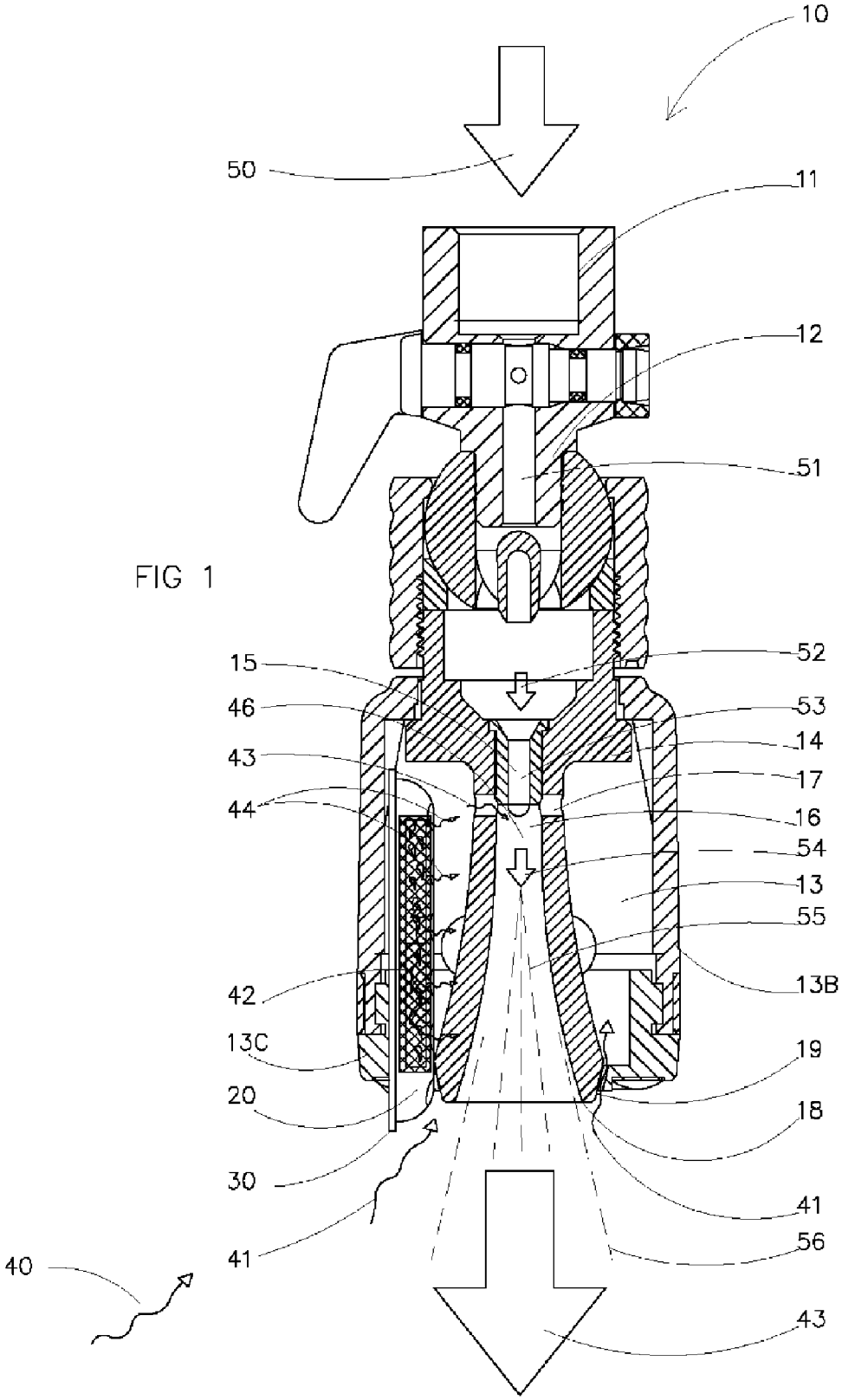
FIG. 1 is a cross-sectional view illustrating a first embodiment of the scent attachment structure of the invention, including the venturi and air aspirating flow through the device.
Figure 2:
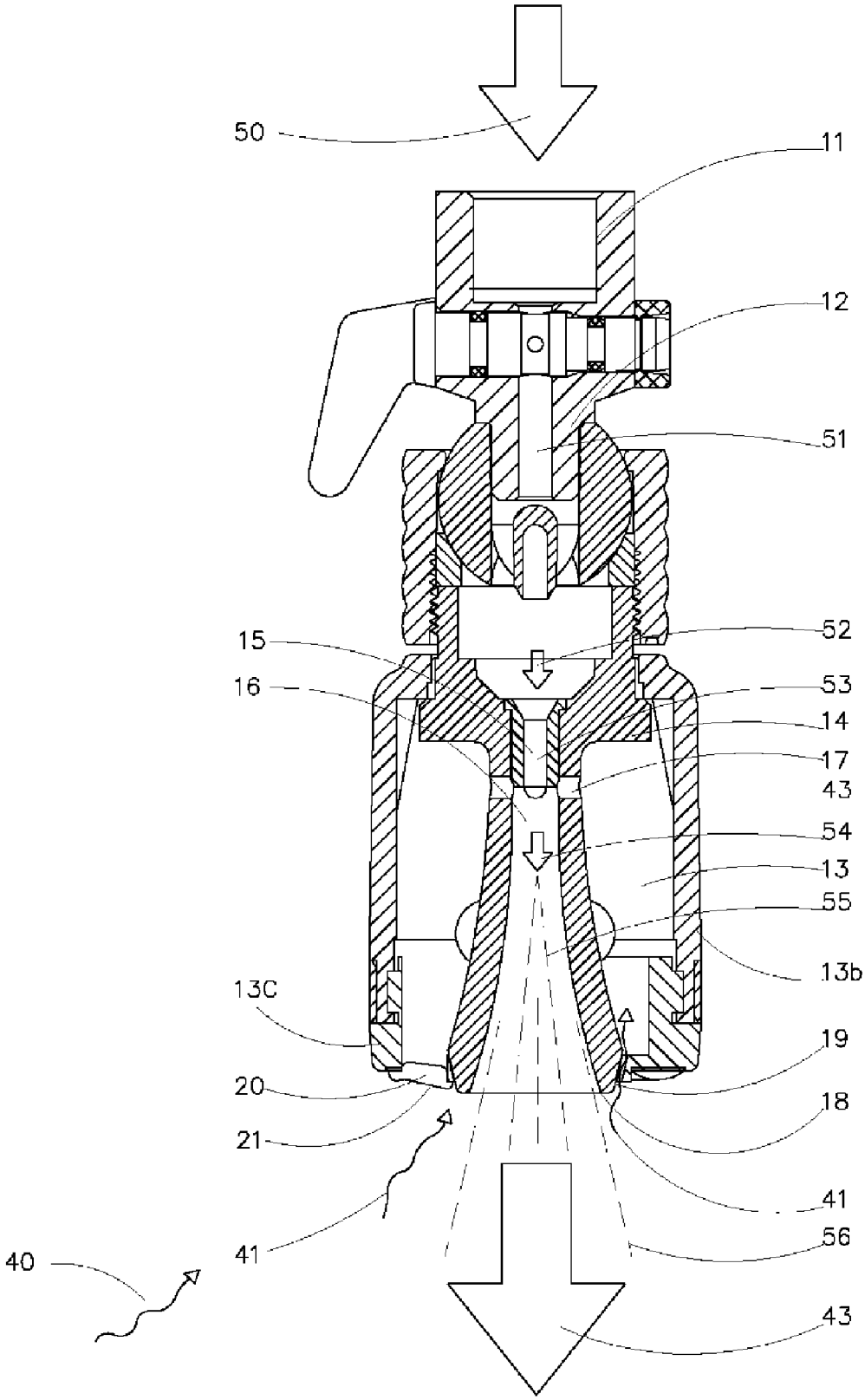
FIG. 2 is a cross-sectional view illustrating the shower head illustrated FIG. 1 with the scent port closed.
Figure 3:
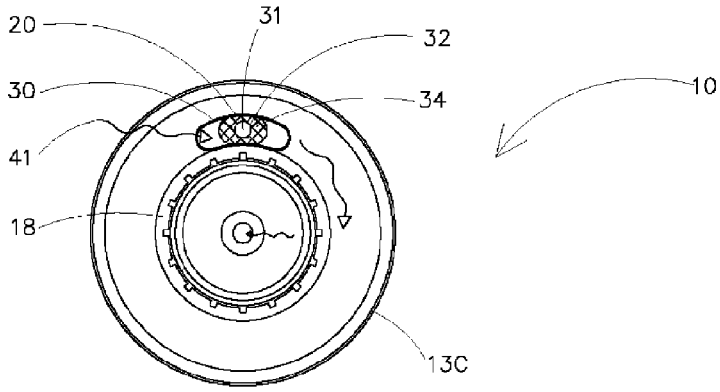
FIG. 3 is a front view, at the shower outlet, illustrating the scent port where the scent cartridge is inserted.
Figure 4A:
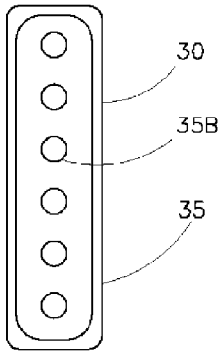
FIG. 4A is a schematic view of the scent cartridge showing the perforated sleeve.
Figure 4B:
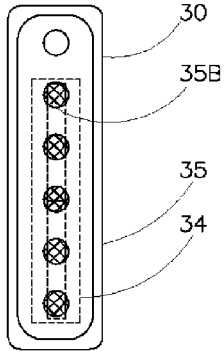
FIG. 4B is a schematic view of the scent cartridge showing an outline of the scent tube and wick.
Figure 4C:
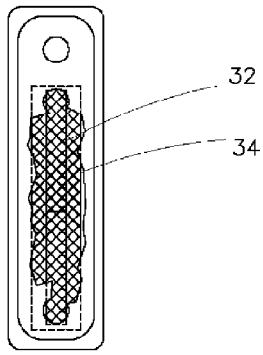
FIG. 4C is a schematic view of the scent cartridge showing a cut-away of the perforated sleeve and showing the wick and scent tube within.
Figure 4D:
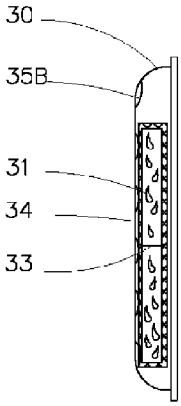
FIG. 4D is a schematic side view of the scent cartridge showing the perforated sleeve, wick and scent tube.
Figure 4E:
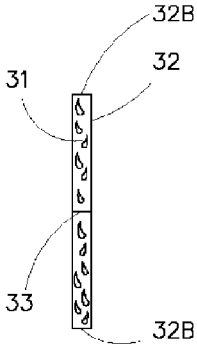
FIG. 4E is a schematic view of the scent tube that is scored, at the break point, and the scent oil within.
Figure 4F:
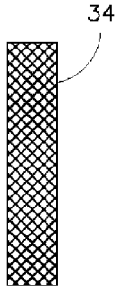
FIG. 4F is a schematic view of the wick that covers at least part of the scent tube.
Figure 4G:
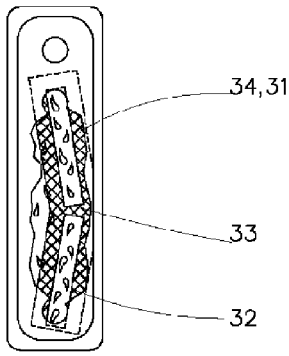
FIG. 4G is a schematic view of the activated scent cartridge showing the scent tube in the "snap break" position and the scent oil on the wick.
Figure 5:
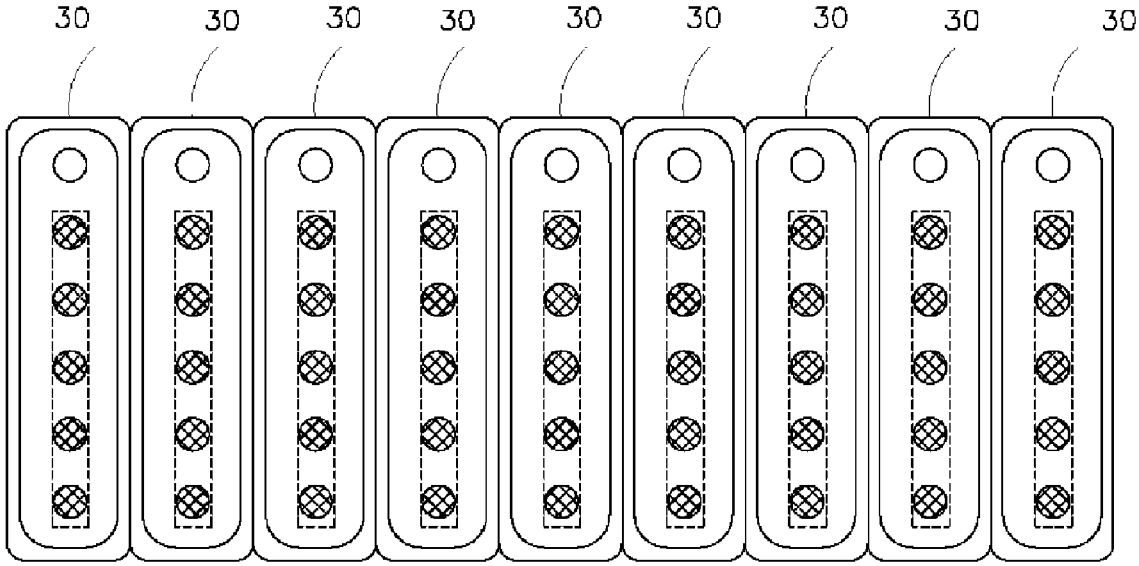
FIG. 5 is a schematic view of a package of scent cartridges.
Figure 6A:
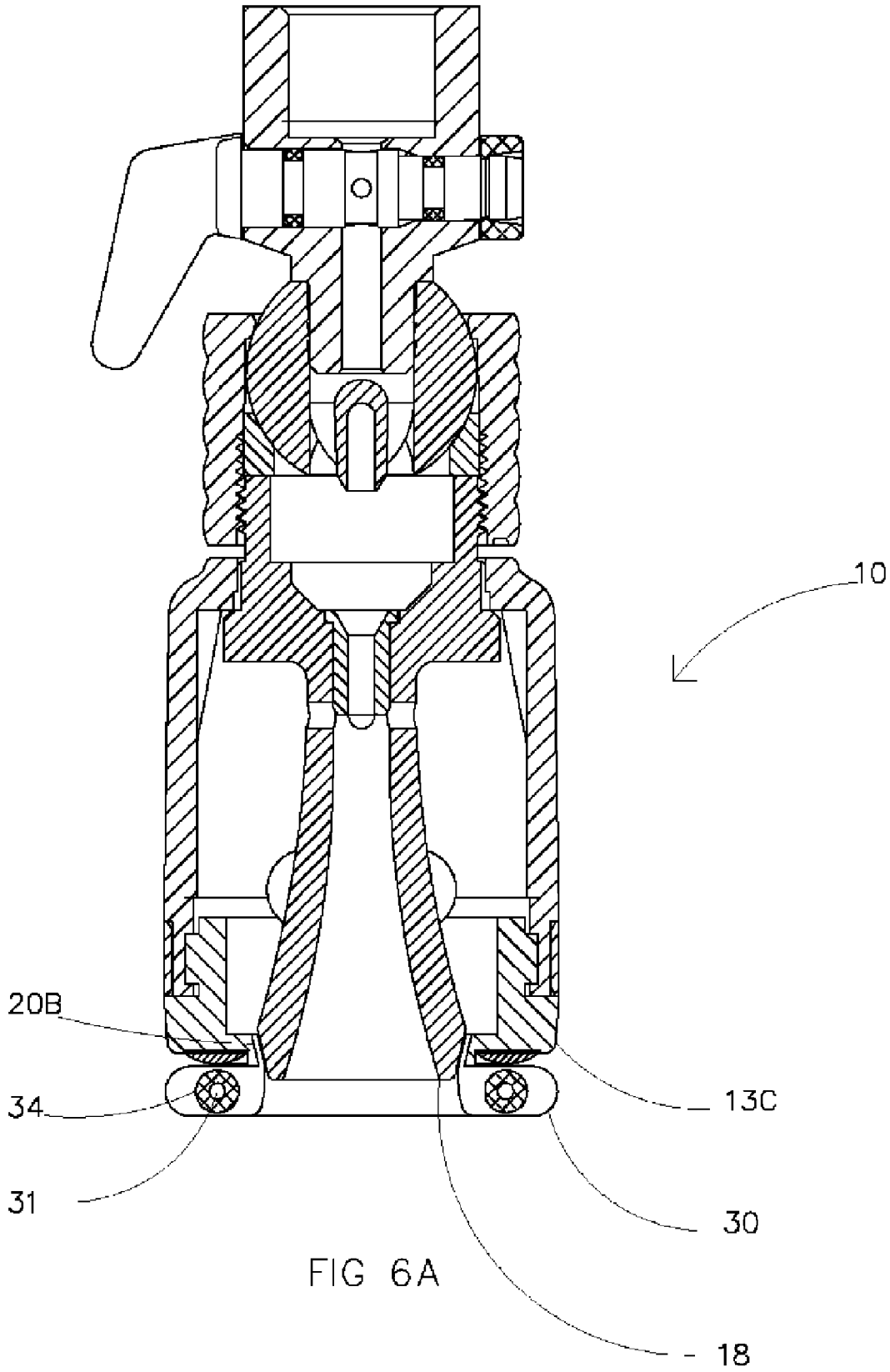
FIG. 6A is a schematic view of a showerhead with a circular shape exterior scent cartridge that clips onto the showerhead face.
Figure 6B:
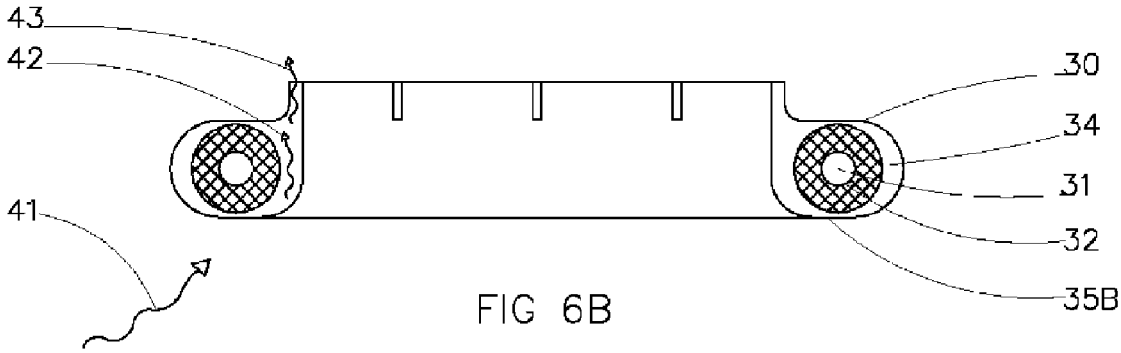
FIG. 6B is an enlarged cross-sectional view of a circular shape exterior scent cartridge.
Figure 7A:
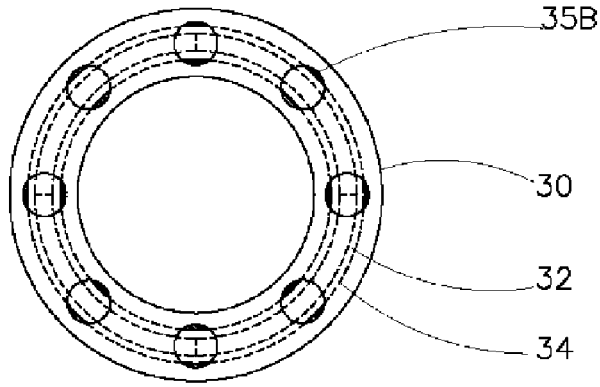
FIG. 7A is a schematic view of a circular shape exterior scent cartridge that clips onto the showerhead face and shows the perforated sleeve.
Figure 7B:
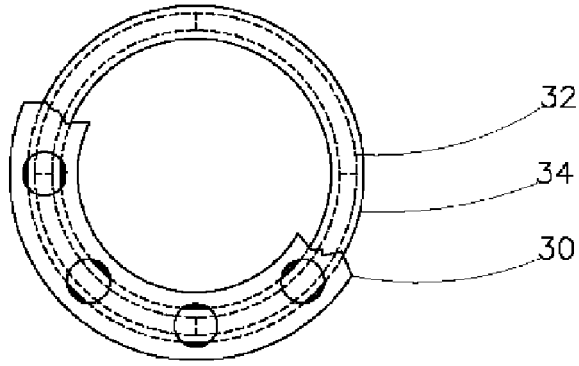
FIG. 7B is a schematic view of 6A with perforated sleeve cover removed and showing wick coved scent tube.
Figure 7C:
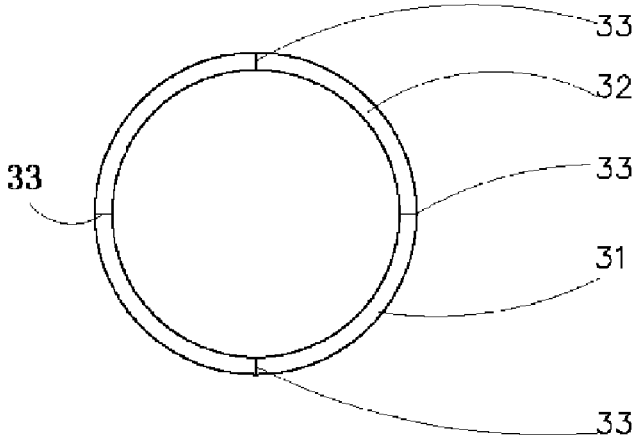
FIG. 7C is a schematic view of the scent tube with score "break" points and scent material within.
Figure 7D:
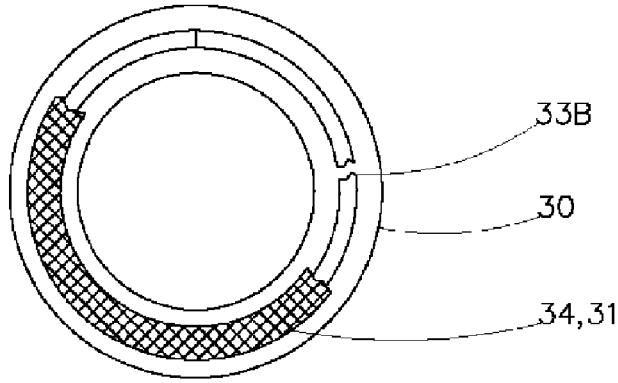
FIG. 7D is a schematic view of the scent tube with score points broken and the scent material on the wick.

The present invention uses the venturi principle of aspirating air into the water stream wherein the water becomes oxygen enriched. One taking a shower simply removes the desired scent from a foil sealed package and inserts one of the scent cartridges into a connection port on the aspirating type showerhead. The port is in fluid communication with a venturi within the shower body. The aspirated air is used to carry the scent molecules from the cartridge to the venturi where a mixture of water and scented air exit the showerhead. The shower compartment then quickly fills with the selected aroma. This invention is a substantial improvement over prior art.

The aspirating scented showerhead is a substantial improvement over prior art. It uses the aspirating air to extract the scent molecules from the scent oil in a disposable cartridge that is inserted into the air chamber of the aspirating showerhead. Only air is used to quickly extract the scent molecules and only an extremely small fraction of scent material is used to fill the room with the desired fragrance. A convenient foil sealed cartridge can contain dozens of small disposable cartridges of various fragrances. Depending of the mood, one can select lavender, orange blossom, apple, or hundreds of other fragrances. Each shower can be a new experience. Children will be more inclined to take showers knowing they will have a wildflower fragrance or other treat. In addition, dissolved oxygen level of the deep well water may increase by a factor of over ten times with the venturi aspirating and mixing air with the water.

This invention utilizes the air aspiration feature to extract scent molecules from a scent cartridge with air flow over the surface of the scented oil, wax or gel on the wick of the scent cartridge. No water is needed at this point, only air. All scents follow the "Perfect Gas Laws" wherein the various gases, in this case a scent, fragrance or vapor continue to leave the liquid or solid state as a gas in a molecular state, until a certain vapor pressure is reached, or equilibrium. The air flow over the scented wick picks up the scent molecules and this scented air enters the venturi portion of the showerhead where it then mixes with the water stream.

The venturi effect causes the aspirated air and scent to thoroughly mix with the incoming low oxygen content supply water. The result is the water becomes enriched with dissolved oxygen from the air and the spray is made up with a fine mixture of water droplets and entrained air plus the scent molecules. Most of the scent molecules remain in the air where it quickly enters the shower compartment or room air as soon as it leaves the showerhead. This allows the shower compartment to quickly fill with a pleasant scent with a minimum use of scent material.

When one is ready to take a scented shower a sealed cartridge is be removed from a storage container. In the preferred form of the invention, a disposable cartridge with a scent and wick is be inserted into a scent port in the showerhead that leads to an air chamber adjacent to the venturi. The protective seal that prevents the loss of scent from the cartridge is preferably removed just before being inserted into the scent port of the showerhead. As long as water flows through the showerhead, aspirated room air is drawn through and over the scent cartridge where the scent molecules mix with the inlet air and exit the showerhead in the spray. When complete, the cartridge is removed and disposed of in the trash. The scent cartridge may be made in a variety of ways. Only a small amount of fast dissipating scent material in a liquid media is needed in the disposable scent cartridge. The seal to prevent the loss of scent material may be a foil packet, tape seal or a breakable plastic tube in the cartridge, the specification of the "Scent Cartridge" are defined below.

When the shower is "on" the incoming aspirated air passes over the scent liquid on the wick in the scent cartridge that is in the attachment port, and picks up fragrance molecules. The scent liquid may be considered a "top note type fragrance" where it gives up scent molecules quickly. It will be understood that the term "top note type fragrance" is a term of the art. The air with fragrance then enters the showerhead air chamber housing and then enters the low pressure area of the venturi. At that point the scented air mixes thoroughly with the high velocity water stream and then exits the showerhead in a spray pattern. The shower compartment quickly fills with the desired scent. The scent cartridges are small, low cost and disposable. They can be stored for long life as a capsule with wick or other sealed package methods.

Briefly, in accordance with the invention, I provide an improved shower head 10. The shower head 10 includes a connection fitting 11 that attaches to a water supply and a ball valve with swivel assembly 12 for regulating flow rate and direction. A venturi 14 is utilized to create a low pressure area 16 where room air 40 can be aspirated into the air chamber 13 then through holes 17 in the venturi 14. The improvements direct the incoming aspirated air 41, 42 into and through a scent attachment cartridge 30 that fits into the port 20 on the showerhead 10. The improvements include a quick connect scent attachment port 20 in the shower housing and a scented cartridge 30. When the shower is "on" and water is flowing through the showerhead, scent molecules 31 will be drawn into the shower spray 56 and pleasantly fill the shower compartment with a desired fragrance.

The air path is in fluid communication to the room air 40, the scent cartridge 30, scented oil 31, and air chamber 13, holes 17, venturi 14, mixing with high velocity jet stream of water 54 and leaving shower water 56. The aspirated air 43 with scent mixture continue to flow in fluid communication to the negative pressure holes 17 at the low pressure area of the venturi 14, and then into the water stream 54. At that point the air, scent and water are mixed together and continue in fluid communication to the exit point of the showerhead wherein a spray pattern of oxygen enriched scented shower water 56 is directed to the person taking a shower.

The user is exposed to a shower stream 56 that has a mixture of aspirated air 41, scent molecules 31 and water 56. A portion of the scent molecules is released into the shower compartment air and the person is exposed to the scent or fragrance. The aspiration of air results in additional oxygen being absorbed by the water within the showerhead. This oxygen enriched water stream mixture results in a more pleasurable shower experience. The additional oxygen in the water enhances the cleaning action of the water.

The Aspirating Scented Showerhead 10 includes the following components:

Connection fitting 11 to a water supply, a nominal ½" threaded connection.

Ball valve assembly 12 to adjust water flow and position angle of shower spray.

Air chamber 13 between venturi and showerhead housing. This area becomes a low pressure zone when shower is "on".

Venturi 14 assembly with water supply orifice 15 that creates a high velocity jet stream of water which creates a low pressure area 16.

Air inlet holes or orifices 17 at narrow, low pressure area 16 of venturi for drawing in air from air chamber 13.

The high velocity jet stream of water from orifice 15 creates a low pressure area 16, that draws in air through air orifices 17 from air chamber 13.

Exterior showerhead air chamber housing 15 surrounds air chamber 13 that surrounds venturi 14 with air inlet orifice 17 openings.

Cone outlet 18 discharge of venturi. This is where the shower spray mixture 56 of water and scented air exit the showerhead.

Aspirating air inlet openings 19 allow ambient air flow into air chamber 13.

Connection port 20 in air chamber 15 for insertion of scent cartridge 30.

Releasable plug 21 to seal scent connection port 20 when not in use.

Scent cartridge 30 with scent liquid 31 in a breakable sealed tube 32 with scored section 33 to weaken tube.

An absorbent wick 34 material surrounds the breakable tube 32 within a thin perforated plastic sleeve or casing 35.

The inlet end of casing 35 may have an enlarged inlet 36 with a butyl check valve 37 that deforms to allow air in and closes when there is no flow.

The outlet 38 of casing 35 has a deformed end to retain tube yet allow air flow through the casing when the shower is "on".

Spray pattern of shower water mixture of water, air and scent molecules are drawn to the interior surface of the venturi 55 due to the created negative air pressure.

The scent cartridge 30 in a preferred embodiment is a relatively small 0.125" outside diameter and a 2" length. The cartridge 30 includes a sealed plastic tube 32 with a scored section 33 that breaks easily when bent. The tube 32 contains the liquid scent material 31. The tube 32 is made from a plastic material (in some embodiments), that will snap and break if bent at the scored section 33, thereby, releasing the scent liquid 31 to the surrounding wick 34. The absorbent wick 34, of tubular shape, covers the tube 32 and absorbs the released scent liquid 31 material. This provides a substantial surface area of scented material that is exposed to the aspirated air path. The absorbent wick 34 and scent tube 32 are located inside of a perforated plastic sleeve or casing 35. The scent cartridge 30 outside dimensions will snugly fit the port opening 20 on the showerhead.

The enlarged inlet 36 of the perforated conduit 35, in another form of the invention, could have a one way butyl check valve 37. When aspirated air passes through and over the scent tube 30 the scent molecules 31*b* are picked up and enter the venturi of the showerhead. When not in use the valve closes. This will allow for several uses of semi-disposable scent cartridge.

In another form of the invention, considered non-disposable, the scent container can hold a large volume of scent oil and last for many months. See FIG. 8 and items 60-66 above.

When the shower is "on" the scented aspirated showerhead 10 allows a nominal 2.2 gallons of water flow per minute. This is accomplished with a ball valve, swivel and flow regulator 12 that may deform with increased pressure thereby regulating the flow to a near constant rate even with high water pressure at the inlet.

The incoming water 50 may be from a well supply source that, is common, and may have a low level of dissolved oxygen in the water. This may be less than one part per million and that is undesirable. It is extremely advantageous to increase the level of dissolved oxygen in the water for improved cleaning action of the water and for having a more refreshing shower. The shower assembly has a venturi 14 where the water passes through. At the inlet area of the venturi 14 the 2.2 gpm of water flow goes through a small diameter opening 15. The water velocity increases to a very high rate at the narrowest point in the venturi 14. At this area of high water velocity, a low pressure 16 occurs. This is the area where a series of small holes 17 occur in the venturi 14 that leads to the air chamber 13 cap of the housing. Openings 19 in the air chamber cap allow room air to enter and make its way to the venturi 14 and into the shower water.

A scent connection port 20 is located on the air chamber 13 cap. A scent cartridge 30 is then inserted into the scent connection port 20. This invention puts the aspirated air to work by directing part of the incoming air over a scented wick 34 in the scent cartridge 30 where it picks up scent molecules 31*b*, thereby, allowing the scented air 43 to enter the holes 17 of the venturi 14 area and ultimately mix with the shower water 54. The desired scented shower water 56 than bathes the shower user in an altered environment of spray water with enhanced dissolved oxygen and scented air. The result is a clean shower and a pleasant aroma.

The aeration sensation of one taking a shower is a spray that feels like 5 to 7 gallons per minute (gpm) flow but where only 2.2 gpm of water may actually be used. The scent material used may be in an oil, wax or gel in a liquid base and be contained in a small tube capsule inside a cartridge where it is stored until ready for use. When ready for use, the scent cartridge 30 can be removed from its storage container and activated by bending and breaking the sealed tube 32 in the cartridge and placing it into the scent attachment port 20 on the showerhead. Air 41 from the shower compartment flows through and over the scent cartridge 30 where it captures scent molecules 31*b* in a vapor or gaseous state. The aspirated air with scent molecules 43 then enters the venturi area 46 of the aspirating showerhead where it is thoroughly mixed with the water spay 56.

A series of high velocity air jets streams pass trough orifices 17 impinging at a sharp angle on a high velocity incoming water jet stream 54 resulting in a highly mixed and aerated solution. This through mixing of aspirated air and water results in the water becoming oxygen enriched from the aspirated air. The water at this point contains millions of small air bubbles with scent molecules. The scent molecules are instantly released from the minute air bubbles in the water droplets or from the aspirated air. The shower user is then bathed and engulfed in a pleasant mixture of oxygen enriched water with scent molecules. Only scent molecules and vapor exit the showerhead.

It is a principal object of the invention to provide improved water conserving shower head with a scent feature. Therefore, this invention is considered a "substantial improvement over prior" by means of an air aspirating shower head that incorporating a scent connection port and disposable scent cartridges.

This invention is shown in the preferred forms of the invention, but those skilled in the art will understand that other embodiments of this invention may have various shapes and sizes. The scent connection port may be built into the showerhead housing and be an integral part of the shower housing or be an attachment device. The invention may also be used in a sink faucet or other water fixture.

Figure 8:
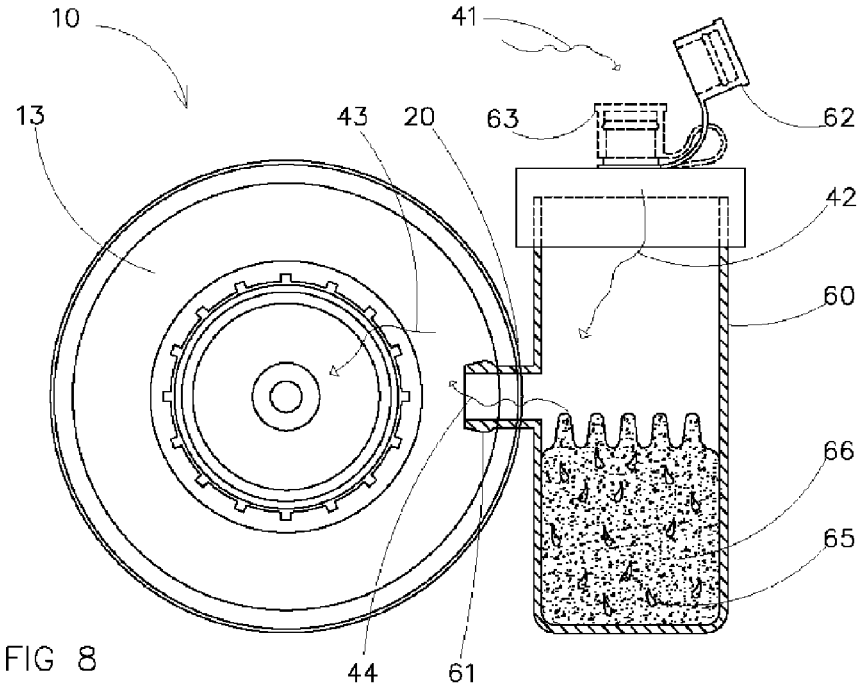
FIG. 8 is an enlarged schematic view of another embodiment invention that includes a reusable scent container with closure cap. This unit has a scent soaked foam wick with an expanded surface within a closeable chamber. A mating outlet connects to the scent port on the showerhead.
Figure 9:
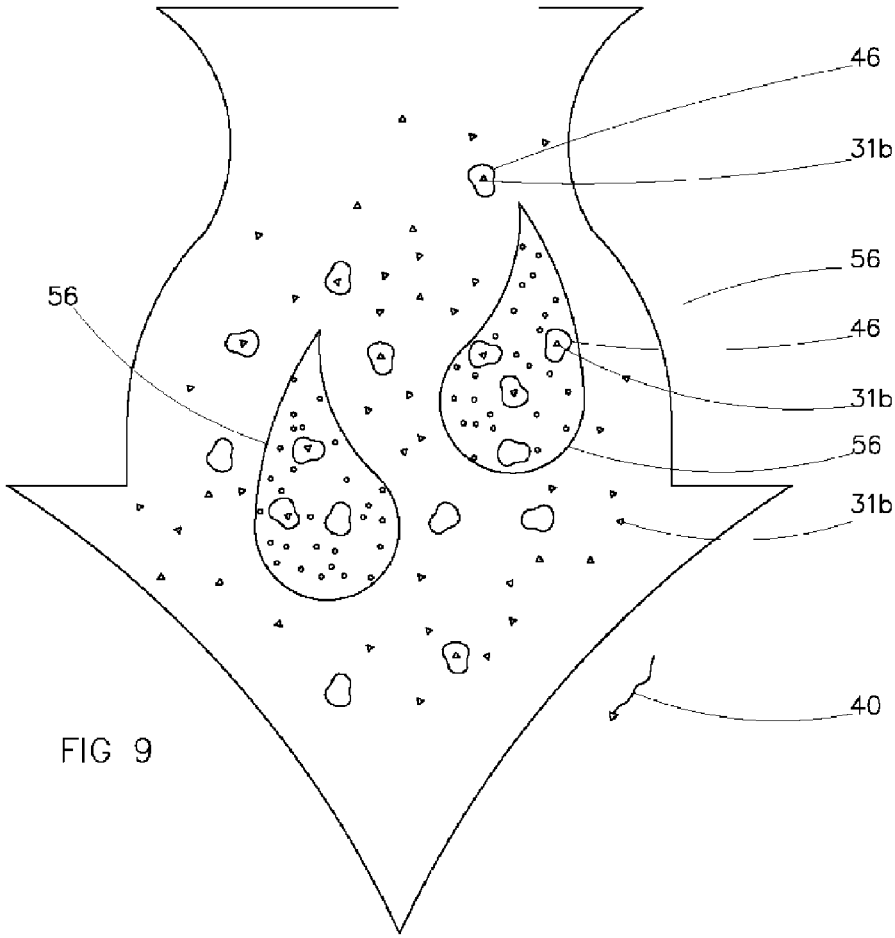
FIG. 9 is a greatly enlarged schematic view of a small portion of the leaving shower water with oxygen enriched water drops and scented air mixture. The water drops are surrounded by the aspirated air with scent molecules. The water drops also contain small air bubbles that contain scent molecules. When the scented air and water droplets contact the body, the droplets break up into smaller drops and entrained scent molecules are released.

In another variation of the invention the scent could be provided in a variety of non-disposable plastic containers. These could then last for many months and any scent could be selected for use. Each container has a small amount of liquid scent and a wetted foam wick with extended surface in part of the container. Part of the foam wick is above the saturated scent liquid level. The foam wick also acts as an anti slosh feature, to keep the scent liquid from spilling out when the cap is removed or if it were accidentally tilted briefly. When ready for use, the selected scent container could be removed from a holder or rack and then connected to the inlet scent port of the shower head as shown in FIG. 8.

A holder or rack could be mounted on the showerhead inlet pipe or on the showerhead directly. The holder could even circumvent the showerhead where it could be rotated until the selected scent lined up with the inlet port on the showerhead. The number of scent containers on the rack could vary. The top opening could be arranged so the incoming aspirated air enters the center of the top, stirs up the vapor and scent in the container, pick up scent molecules and exits the same opening. A flexible conduit carries the scented air to the showerhead scent inlet port.

In other variations, the scent could be provided in spray bottles or pump that allows a slight touch of a button to dispense the selected scent wherein the scent molecules are in fluid communication with the aspirated air and showerhead venturi. A remote located scent container is used with an extended tube in fluid communication to the scent port on the showerhead in some embodiments.

This invention utilizes the air aspiration feature to extract the scent molecules with air flow directly over the surface of the scented oil, wax or gel or scent impregnated wick material. No water is needed at this point, only air. All scent molecules follow the "Perfect Gas Laws" wherein the various gases, in this case a scent, continue to leave the liquid or solid state as a gas until a certain vapor pressure is reached. The air flow over the scented oil or wick picks up the scent molecules and this scented air enters the venturi portion of the showerhead where it then mixes with the water stream.

Therefore, the venturi effect causes the aspirated air and scent to thoroughly mix with the incoming low oxygen level water. The result is the water becomes enriched with dissolved oxygen from the air and the spray is made up with a fine mixture of water droplets and entrained air plus the scent molecules. The dissolved oxygen level may now be many times greater than the well water supply. Most of the scent molecules remain in the air where it quickly enters the ambient room air as soon as it leaves the showerhead. This allows the shower compartment to quickly fill with a pleasant scent with a minimum use of scent material and without eye irritation or coating the body with an oily film.

High quality fragrance scent material is costly and this method uses an extremely small amount of scent material, probably less than 1% of a conventional prior art shower methods.

This aspirating scented showerhead has numerous advantages over prior art. The aerated water not only adds oxygen to the incoming water but results in a sensation of a high water flow rate. Therefore, less water is used, less heat energy is used to heat the water, less scent material is used and this saves cost, less scent material goes down the drain and this reduces water pollution problems. The elimination of scent oils getting into ones eyes results in a more healthful shower.

The following numerical listing of the elements relates to the embodiments illustrated in FIGS. 1-7D:

10 Aspirating scented shower head

11 Connection fitting to water supply

12 Ball valve with swivel assembly for regulated flow rate. This item may also contain a deformable flow regulator that increases resistance with increased pressure.

13 Air chamber between venturi and shower housing. This is at low pressure when shower is "on".

14 Venturi assembly

15 Orifice for water supply

16 Low pressure area at venturi

17 Holes at low pressure area of venturi for aspirated air

18 Outlet of venturi

19 Aspirated air inlet openings

20 Scent inlet port

21 Releasable plug

30 Scent cartridge assembly

31 Scent material—liquid media in tube

31B Scent molecules or vapor

32 Scent tube, small diameter plastic

32B Sealed ends of scent tube.

33 Scored area of tube that breaks when tube is bent

34 Wick that surrounds tube

35 Plastic sleeve over wick

35*b* Perforated holes in sleeve

36 Enlarged inlet port of sleeve

37 Inlet check valve, normally closed, at inlet of sleeve

38 Narrowed outlet of sleeve to ease insertion into port 20 and to help retain tube

40 Ambient air in shower area

41 Aspirated ambient air entering air inlet openings 19

42 Aspirated air entering or flowing over scent cartridge 30

43 Aspirated air with scent molecules leaving scent cartridge 30

44 Aspirated air with scent molecules entering air chamber 13

45 Aspirated air with scent molecules entering venturi through holes 17

46 Aspirated air with scent molecules mixing with water within venturi

50 Supply water at service pressure may be low in dissolved oxygen.

51 Supply water at regulated pressure

52 Supply water through flow regulator

53 Supply water at high velocity in orifice

54 Jet stream of supply water at venturi

55 Water drawn to interior surface of venturi due to negative pressure area

56 Shower water with aspirated air and scent molecules leaving showerhead

The embodiment of the invention illustrated in FIG. 8 is not disposable; the scent container can hold a large volume of scent oil and the quantity of oil will last for many months. A rack with multiple containers with different scents may be hung at the showerhead for easy access. The illustrated container shape is very diagrammatic and other embodiments may streamline the size and shape of the container to suit the contours of the showerhead body. The mating scent port 20 connection at the showerhead may be on the side or other location.

The following items 60-67 relate to the embodiment of the invention illustrated in FIG. 8:

60 Scent container for long term use—plastic.

61 Cap—screw on. This allows refilling with scent oil.

62 Snap-cap seal at air inlet port. This is closed when not in use.

63 Air inlet port.

64 Scented air outlet port. This port covered by a cap (not shown) when not in use.

65 Scent oil, or wax or gel. The fragrance may be of any selected aroma.

66 Foam wick with extended exposed surface area. The foam holds scent oil for anti-spill feature.

Figure 10:
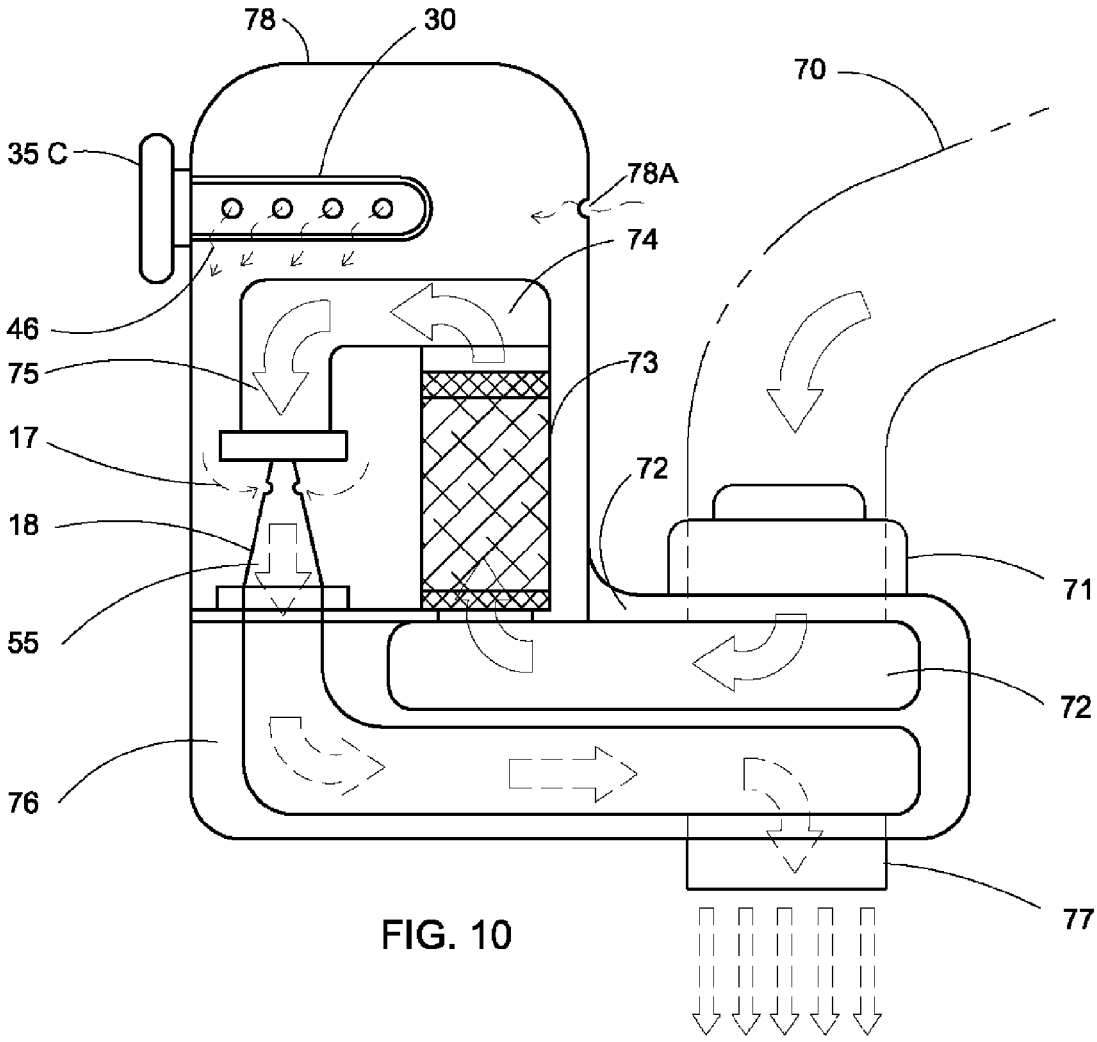
FIG. 10 is a schematic view of a combination filter, aerator and scent assembly that can be adapted to an existing kitchen faucet.

FIG. 10 is a schematic view of a combination filter, aerator and scent assembly that can be adapted to an existing kitchen faucet. This would be an embodiment that is a retrofit model that would fit on the outlet extremity of the kitchen faucet in the same manner as some aftermarket filter systems do. The housing can be rotated to the side in almost any position. The water outlet is directly under the faucet outlet. The filter can remove solids, and various impurities. The filter may include different medias such as activated carbon to remove iron, lead and other impurities. The scent knob could be rotated to an "open" or "closed" position. In the "closed position", the scent would be sealed. The cartridge may contain a 3 month supply of scent material. This embodiment shows an adapter 71 that connects to the existing kitchen faucet 70 outlet. Water flows through inlet conduit 72 and then through filter assembly 73. Then the water flows through filter outlet conduit 74 to venturi inlet 75. Water flows through venturi 18, and air is drawn through housing inlet 78A, picks up scent molecules 31B, and then flows through venturi air inlets 17 and mixed with water 55. The water, air and scent mixture 55 enters conduit 76 and exits outlet 77. The scent cartridge 30 may have a rotation knob 35C that allows the scent cartridge to be closed or open.

Figure 11:
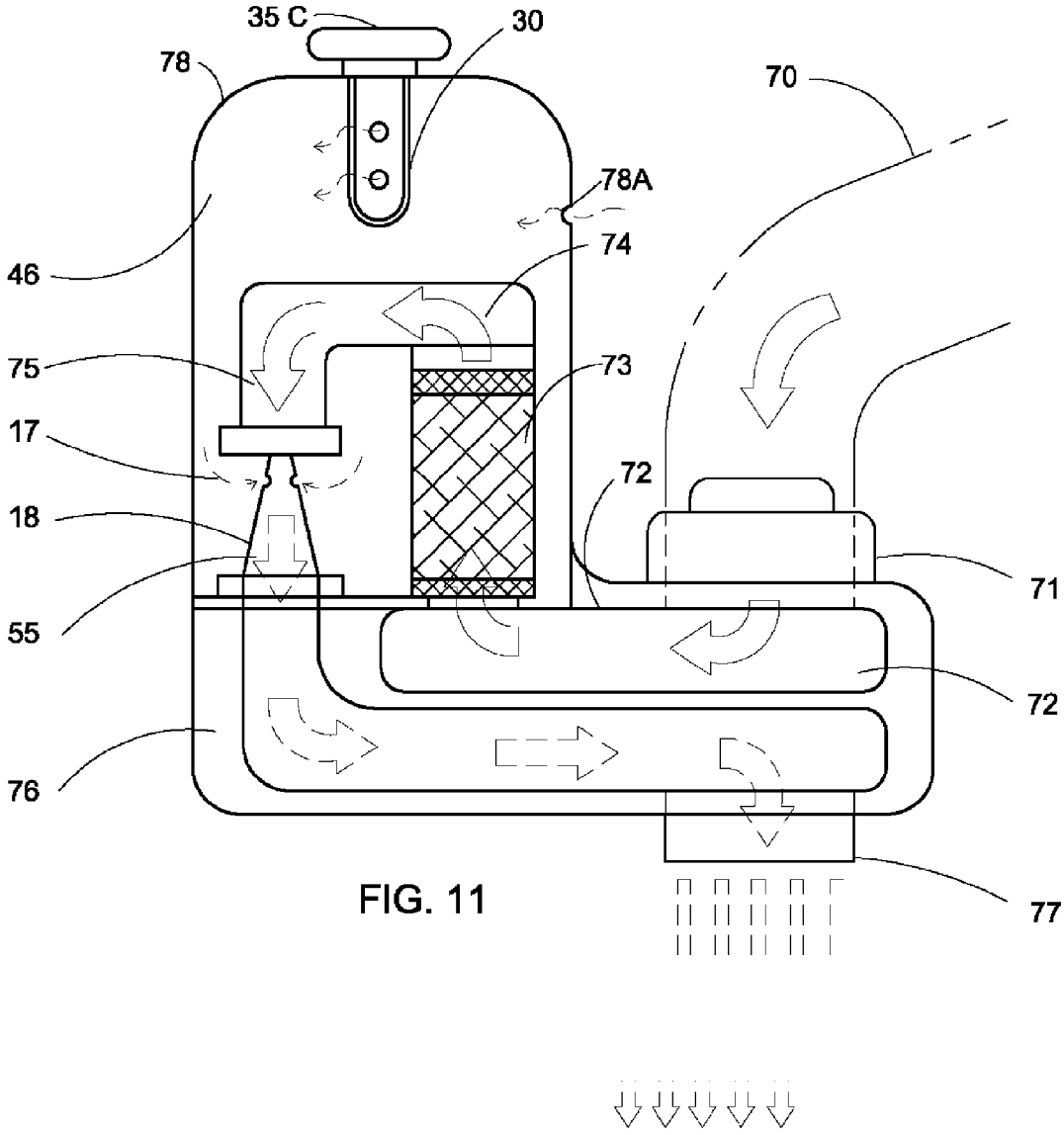
FIG. 11 is a schematic view of a combination aerator and scent assembly that can be adapted to an existing bathroom faucet.

FIG. 11 is a schematic view of a combination aerator and scent assembly that can be adapted to an existing bathroom faucet. This would be an embodiment that is a retrofit model that would fit on the outlet extremity of the bathroom faucet. The water outlet can be directly under the faucet outlet. The scent knob could be rotated to an open or closed position. In the closed position, the scent cartridge may contain a 3 month supply of scent material. This embodiment shows an adapter 71 that connects to the existing bathroom faucet 80 outlet. Water flows through a conduit 72 to venturi 18 where air and scent molecules are picked up and drawn through ports 17. The water, air and scent molecules enter conduit 76 and exit outlet 77.

Figure 12:
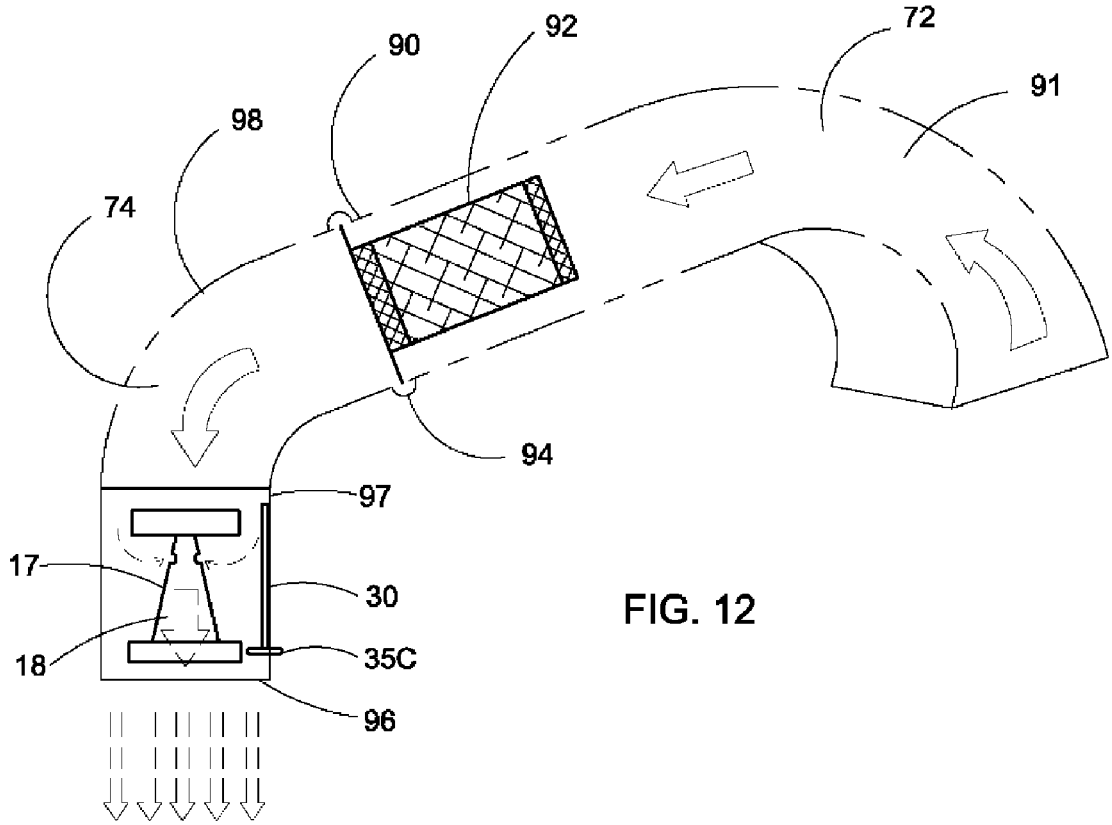
FIG. 12 is an embodiment that is an original equipment faucet. It may have a filter, venturi for aeration, and a scent cartridge similar to that shown in FIG. 10.

FIG. 12 is an embodiment that is an original equipment faucet. It may have a filter, venturi for aeration, and a scent cartridge similar to that shown in FIG. 10. The filter may be in line and a section of the facet may be removable for filter replacement. A side entry filter access could also be provided. The faucet may also be made without the integral filter option. This embodiment illustrates an original equipment faucet 90 with a in-line filter 92 within the faucet conduit 91. Water exits the filter outlet 93. A connecting faucet outlet conduit 92 is attached to conduit 91 by an "O" Ring or gasket containing coupling 94. Water flows through venturi 18 where air and scent molecules inter ports 17 and mix within the venturi 18. 6. Water flows through venturi 18, and air is drawn through housing inlet 78A, picks up scent molecules 31B, and then flows through venturi air inlets 17 and mixed with water 55. The water, air and scent mixture 55 exits venturi 18 and outlet 96. The scent cartridge 30 may have a rotation knob 35C that allows the scent cartridge to be closed or open. A variation of this embodiment may be used with a showerhead so that an in-line filter, aeration, and scent can be provided.

It will be understood that the present invention keeps the scented oil from directly mixing with the water supply and only allows aspirated air to flow over the scented material and, to remove fragrance molecules from an aromatic substance, and then mix the fragrance molecules with water directed at the individual who is bathing. This results in the least amount of scent material being used and thereby reduces the waste of scented oils.

While the present invention has been described in terms of a showerhead embodiment, those skilled in the art, will recognize that other embodiments may include faucet assemblies. For example, such faucet assemblies may be used in a bathroom to maintain a pleasant atmosphere. In addition, such faucet assemblies may be used in a kitchen to also maintain a pleasant atmosphere. Various devices are presently marketed that connect to the building the electric power supply and utilize a small heater to cause a pleasant aroma to be dispensed to the atmosphere. The present apparatus has significant advantages over such apparatus and that he does not require electric power or any other kind of power supplied by the user. The utilization of a venturi apparatus of the present invention with the conventional city water supply is thus environmentally advantageous.

Those skilled in the art will also recognize that the present invention may have still more applications. For example, any fluid stream (liquid or gaseous fluid stream) may be used with a venturi to produce a low pressure area and thereby the draw molecules of scent a material from a reservoir of scent material. Thus, any axial part of a water pipe may be utilized with a venturi to produce the area of pressure that is lower than ambient pressure to draw molecules of scent material from a reservoir of scent material.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A showerhead apparatus which comprises:

a first fluid passageway for conducting a stream of water, said first fluid passageway including a fitting for connecting to a water supply conduit and for receiving water into said first fluid passageway, said first fluid passageway further including an outlet for expelling fluid from within said first fluid passageway;

said first fluid passageway further including a constricted section forming a venturi having a low pressure region within said first fluid passageway having a pressure that is less than ambient air pressure when water flows from said fitting through said first fluid passageway to be expelled by said outlet;

a second gas passageway connected to the low pressure region of said venturi by one or more ports, said second gas passageway including one or more inlets exposed to the ambient air for receiving air into said second gas passageway, said venturi's low pressure region causing air to aspirate through said one or more inlets into said second gas passageway to enter said first fluid passageway through said ports;

an insertable and removable scent cartridge positioned within said second gas passageway, said scent cartridge including a housing and a scented material within said housing, said housing including one or more openings to allow air entering said second gas passageway to pass over said scented material to create a scented gas within said second gas passageway without said scented material mixing with water within said first fluid passageway as a result of said venturi aspirating air into said second gas passageway through said one or more inlets;

wherein said venturi aspirates the scented gas through said ports where the scented gas mixes with water in said first fluid passageway to form a water-scented gas mixture which is expelled from said outlet.

2. The showerhead as described in claim 1 wherein said first fluid passageway is tubular and said second gas passageway extends radially around said first fluid passageway to form an annular gas passageway.

3. The showerhead as described in claim 2 wherein said one or more inlets includes a plurality of inlets surrounding and adjacent to said outlet.

4. The showerhead as described in claim 2 wherein said scent cartridge is annularly shaped to be positioned within said annular gas passageway.

5. The showerhead as described in claim 1 wherein said second gas passageway is dimensioned and configured for receiving an elongated scent cartridge.

6. The showerhead as described in claim 1 wherein said scent material is in wax form.

7. The showerhead as described in claim 1 wherein said scent cartridge has a removable seal that covers said one or more housing openings, said seal preventing air from passing over said scent material but the removal of said seal allowing air to pass over said scent material.

8. The showerhead as described in claim 1 wherein said scent cartridge includes a wick.

9. The showerhead as described in claim 1 wherein said scent cartridge housing is made of plastic.

10. A showerhead apparatus which comprises:

a tubular fluid passageway for conducting a stream of water, said tubular fluid passageway including a fitting for connecting to a water supply conduit and for receiving water into said tubular fluid passageway, said tubular fluid passageway further including an outlet for expelling fluid from within said fluid passageway;

said tubular fluid passageway further including a constricted section forming a venturi having a low pressure region within said tubular fluid passageway having a pressure that is less than ambient air pressure when water flows from said fitting through said tubular fluid passageway to be expelled by said outlet;

an annular gas passageway concentrically surrounding said tubular fluid passageway, said annular gas passageway connected to the low pressure region of said venturi by one or more ports, said gas annular passageway including a plurality of inlets surrounding and adjacent to said outlet and exposed to the ambient air for receiving air into said annular gas passageway, said venturi's low pressure region causing air to apsirate through said one or more inlets into said annular gas passageway to enter said tubular fluid passageway through said ports;

an insertable and removable scent cartridge positioned within said annular gas passageway, said scent cartridge including a housing and a scented material within said housing, said housing including one or more openings to allow air entering said annular gas passageway to pass over said scented material to create a scented gas within said annular gas passageway without said scented material mixing with water within said tubular fluid passageway as a result of said venturi aspirating air into said annular gas passageway through said one or more inlets;

wherein said venturi aspirates the scented gas through said ports where the scented gas mixes with water in said tubular fluid passageway to form a water-scented gas mixture which is expelled from said outlet.

11. The showerhead as described in claim 10 wherein said annular gas passageway is dimension and configured for receiving an elongated scent cartridge.

12. The showerhead as described in claim 11 wherein said scent cartridge is annularly shaped to be positioned within said annular gas passageway.

13. The showerhead as described in claim 10 said scent material is in wax form.

14. The showerhead as described in claim 10 wherein said scent cartridge has a removable seal that covers said one or more housing openings, said seal preventing air from passing over said scent material but the removal of said seal allowing air to pass over said scent material.

15. The showerhead as described in claim 10 further including an attachable and detachable circular hollow external canister connected to said inlets and forming an extension of said annular gas passageway, said scent cartridge positioned within said external canister.

16. A method of producing an aromatized fluid including a liquid and scented gas comprising the steps of:

providing a showerhead apparatus which comprises having a first fluid passageway for conducting a stream of water, the first fluid passageway including a fitting for connecting to a water supply conduit and for receiving water into the first fluid passageway, the first fluid passageway further including an outlet for expelling fluid from within the first fluid passageway, the first fluid passageway further including a constricted section forming a venturi having a low pressure region within the first fluid passageway having a pressure that is less than ambient air pressure when water flows from the fitting through the first fluid passageway to be expelled by the outlet, a second gas passageway connected to the low pressure region of the venturi by one or more ports, the second gas passageway including one or more inlets exposed to the ambient air for receiving air into the second gas passageway, the venturi's low pressure region causing air to aspirate through the one or more inlets into the second gas passageway to enter the first fluid passageway through the ports, an insertable and removable scent cartridge positioned within the second gas passageway, the scent cartridge including a housing and a scented material within the housing, the housing including one or more openings to allow air entering the second gas passageway to pass over the scented material to create a scented gas within the second gas passageway without the scented material mixing with water within the first fluid passageway as a result of the venturi aspirating air into the second gas passageway through the one or more inlets, wherein the venturi aspirates the scented gas through the ports where the scented gas mixes with water in the first fluid passageway to form a water-scented gas mixture which is expelled from the outlet; and flowing water through the first fluid passageway to create the low pressure region within the first fluid passageway having a pressure that is less than ambient air pressure causing ambient air to aspirate through the one or more inlets into the second gas passageway to enter the first fluid passageway through the ports, wherein air entering the second gas passageway passes over the scented material to create the scented gas within the second gas passageway without the scented material mixing with water within the first fluid passageway as a result of the venturi aspirating air into the second gas passageway through the one or more inlets, wherein the venturi aspirates the scented gas through the ports where the scented gas mixes with water in the first fluid passageway to form the water-scented gas mixture which is expelled from the outlet.

17. The showerhead as described in claim 16 wherein said first fluid passageway is tubular and said second gas passageway extends radially around said first fluid passageway to form an annular gas passageway.

18. The showerhead as described in claim 17 wherein said one or more inlets includes a plurality of inlets surrounding and adjacent to said outlet.

* * * * *